US005957821A

United States Patent [19]

Scharbrodt et al.

[11] Patent Number: 5,957,821

[45] Date of Patent: Sep. 28, 1999

[54] APPARATUS FOR CUTTING A STRIP-TYPE PACKAGING

[75] Inventors: Paul Scharbrodt, Leverkusen; Siegbert Feja; Eckhard Hoffmann, both of Wolfen, all of Germany

[73] Assignee: Bayer Bitterfeld GmbH, Greppin, Germany

[21] Appl. No.: 08/968,243

[22] Filed: Nov. 12, 1997

[30] Foreign Application Priority Data

Dec. 13, 1996 [DE] Germany ..... 196 51 954

[51] Int. Cl.[6] ..... B31B 1/14

[52] U.S. Cl. ..... 493/11; 493/22; 493/196; 493/202; 493/236; 493/370; 83/37; 83/76; 83/311

[58] Field of Search ..... 493/8, 10, 11, 493/22, 25, 197, 196, 201, 202, 236, 370; 83/37, 76, 289, 311, 370, 371, 365

[56] References Cited

U.S. PATENT DOCUMENTS

| | | | |
|---|---|---|---|
| 2,420,983 | 5/1947 | Salfisberg | 93/3 |
| 4,000,888 | 1/1977 | Gardner et al. | 270/21 |
| 4,019,947 | 4/1977 | Stock et al. | 156/510 |
| 4,086,846 | 5/1978 | Hall | 93/77 FT |
| 4,227,683 | 10/1980 | Spangler et al. | 270/61 F |
| 4,548,594 | 10/1985 | Lotz | 493/370 |
| 4,731,542 | 3/1988 | Doggett | 250/548 |
| 4,905,159 | 2/1990 | Loriot | 364/470 |
| 4,951,444 | 8/1990 | Epstein et al. | 53/77 |
| 5,000,725 | 3/1991 | Baukneht | 493/11 |
| 5,347,791 | 9/1994 | Ginzl et al. | 53/450 |
| 5,782,731 | 7/1998 | Kohn et al. | 493/16 |

FOREIGN PATENT DOCUMENTS

| | | | |
|---|---|---|---|
| 0083912 | 7/1983 | European Pat. Off. . | |
| 1262118 | 9/1968 | Germany . | |
| 7706759 | 10/1978 | Germany . | |
| 2945251 | 5/1981 | Germany . | |
| 3730097 | 5/1988 | Germany . | |
| 4242702 | 7/1993 | Germany . | |
| 4337514 | 5/1994 | Germany . | |
| 4443753 | 6/1996 | Germany . | |
| 8026229 | 1/1996 | Japan . | |
| 765473 | 1/1954 | United Kingdom | 493/11 |
| 2 272 982 | 6/1994 | United Kingdom | 493/11 |

*Primary Examiner*—Lee W. Young
*Assistant Examiner*—Bobby Rushing
*Attorney, Agent, or Firm*—Sprung Kramer Schaefer & Briscoe

[57] ABSTRACT

An apparatus for the dimensionally accurate cutting of a product carrier (1) which is in the form of a strip, is transported further in a cyclic or continuous manner in the longitudinal direction and has cells which are arranged one behind the other and are sealed in an airtight manner comprises a rotating cutter roller (15), which severs the product carrier (1) in each case in the region of a sealing web (4) which is situated between two cells (2), is arranged transversely with respect to the longitudinal direction and is provided with a lattice-like embossing (19). In order to identify and localise the sealing web (4), an optical reflection sensor (6) is arranged above and/or below the product carrier (1) and generates an AC voltage signal which corresponds to the lattice structure when the sealing web (4) is located in the region of the reflection sensor (6), the number of periods being a measure of the width b of the sealing web (4). The AC voltage signal is subjected to further processing in an evaluation circuit (21), which controls the rotational speed of the cutter roller (15) in such a way that the separating cut is positioned as exactly as possible in the centre (b/2) of the sealing web (4). The reflection sensor (6) advantageously comprises an optoelectronic position measuring system which operates according to the triangulation principle.

6 Claims, 4 Drawing Sheets

APPARATUS FOR CUTTING A STRIP-TYPE PACKAGING

BACKGROUND OF THE INVENTION

The invention relates to an apparatus for the dimensionally accurate cutting of a product carrier which is in the form of a strip, is transported further in a cyclic or continuous manner in the longitudinal direction and has cells which are arranged one behind the other, are sealed in an airtight manner and in which sensitive products are packaged. An apparatus of this type fundamentally comprises a rotating cutter roller, which severs the product carrier in each case in the region of a sealing web which is situated between two cells, is arranged transversely with respect to the longitudinal direction and is provided with a lattice-like embossing.

Sensitive products should in this case be understood to mean solid, pasty or liquid products which are sensitive with regard to drying out or the ingress of moisture or else with regard to their sterility (contamination by microorganisms). Typical products in the foodstuffs industry are, for example, mustard, mayonnaise or ketchup, and typical products in the pharmaceutical industry are tablets, including sugar-coated tablets, skin gels or ointments.

Packaging for moisture-sensitive pharmaceutical preparations in tablet form frequently uses foil and film which are sealed closed around the tablets; that is to say each tablet is situated in a cell which is sealed in an airtight manner and is bounded all around on the outside by sealing seams. As a rule, a plurality of sealed tablets, for example two or four, are accommodated in one package unit in the form of a strip. Aluminium foil composites are particularly suitable as packaging material. In order to use the medicament, a strip unit with tablets is removed from the supply pack and the foil is torn open in the vicinity of a tablet, so that the tablet is available. The sealing machine, in production mode, provides the tablets such that they are sealed in in an airtight manner on a foil/film-type tablet carrier, in which each tablet is enclosed in a square by two longitudinal sealing webs and two transverse sealing webs. The longitudinal sealing webs are arranged parallel to the edges of the foil/film carrier and the transverse sealing webs are arranged perpendicularly thereto. During fabrication and automatic packaging, the tablet carrier is then cut off in each case in the region of a transverse sealing web, thereby producing smaller package units in strip form and each having two or four tablets, for example, which units are then packed ready for sale in a box of 10 to 40 units.

The cutting-off apparatus that is usually employed is a rotating cutter roller, which is in a fixed cycle ratio with the preceding sealing roller, in order that the separating cut is made in each case as exactly as possible (±1 mm) in the centre of a transverse sealing web. However, it has been shown in operational practice that the tolerances of the sealing seams or webs in the longitudinal direction are so large, on account of length fluctuations of the foil/film-type tablet carrier, that it is not possible to achieve the accuracy demanded above. Such fluctuations are to be attributed to the fact that in the course of production, the tablet carrier is alternately accelerated and braked and, consequently, exposed to great mechanical stresses. The resultant inaccuracy in the separating cut has the effect that in unfavourable cases the transverse sealing web is cut at the edge or even outside the web width and the requisite reliably tight sealing-in of the tablets is no longer ensured. In these cases, air and/or moisture can penetrate and the storage life of the tablets is greatly reduced. In the worst case scenario, it is even necessary to block entire batches.

SUMMARY OF THE INVENTION

The invention is based on the object, in the case of a foil/film-type product carrier (strip-type packaging) having sealed-in products, of carrying out the separating cut within a transverse sealing web, provided with lattice-like embossings, between two product rows with such a high accuracy that, in the case of the ultimately packaged products, a sufficiently large sealing edge width remains and it is possible to guarantee a hermetically airtight closure of the sealed-in products and, accordingly, the storage life dates envisaged. In particular, the object consists in controlling the control of the cutter roller for cutting off the package-conforming product strips as a function of the position of the transverse sealing web in the longitudinal direction in such a way that the separating cut is located as accurately as possible in the centre of the web.

Starting from the apparatus described in the introduction, this object is achieved according to the invention by virtue of the fact that, in order to identify and localise a transverse sealing web provided with an embossing, an optical reflection sensor is arranged above and/or below the foil/film-type product carrier and generates an AC voltage signal which corresponds to the lattice structure when the sealing web is located in the detection region of the reflection sensor, the number of periods being a measure of the width b of the transverse sealing web, and that an evaluation circuit for the AC voltage signal is provided, which evaluation circuit controls the rational speed of the cutter roller in such a way that the separating cut is made in the centre (b/2) of the transverse sealing web. The invention is therefore based on the fact that the optical measuring apparatus detects and individually identifies the position of each transverse sealing web, and thus its centre as well, and actuates the cutter roller as a function of this. Accordingly, in contrast to the product fabrication known to date, the apparatus operates not with a fixed cycle ratio between the sealing machine and the cutter roller, but with a variable cycle which is dependent on the actual position of the sealing web. The products are, in particular, pharmaceutical products which are sensitive with regard to moisture or sterility, such as, for example, tablets, including sugar-coated tablets, or ointments.

The reflection sensor preferably comprises an optoelectronic position measuring system which operates according to the triangulation principle.

In accordance with a particular embodiment of the invention, the function of the evaluation circuit consists in the rotational speed of the cutter roller being decreased or increased as a function of the metrologically acquired position of the centre of the transverse sealing web.

The invention affords the following advantages:

- The separating cut is made in the centre of the sealing web with an accuracy of ±0.5 mm. Cutting errors which lead to product cells that are not tight and hence to serious packaging defects are prevented as a result of this.
- By precluding this source of defects, the requisite product storage life can be reliably adhered to. Subsequent checking that is otherwise customary can be obviated.
- The destruction of finished merchandise having defectively cut sealing webs and customer complaints on account of spoilt products are avoided.

The invention is explained in more detail below using exemplary embodiments with reference to drawings, in which

DETAILED DESCRIPTION OF THE INVENTION

Figure 1:
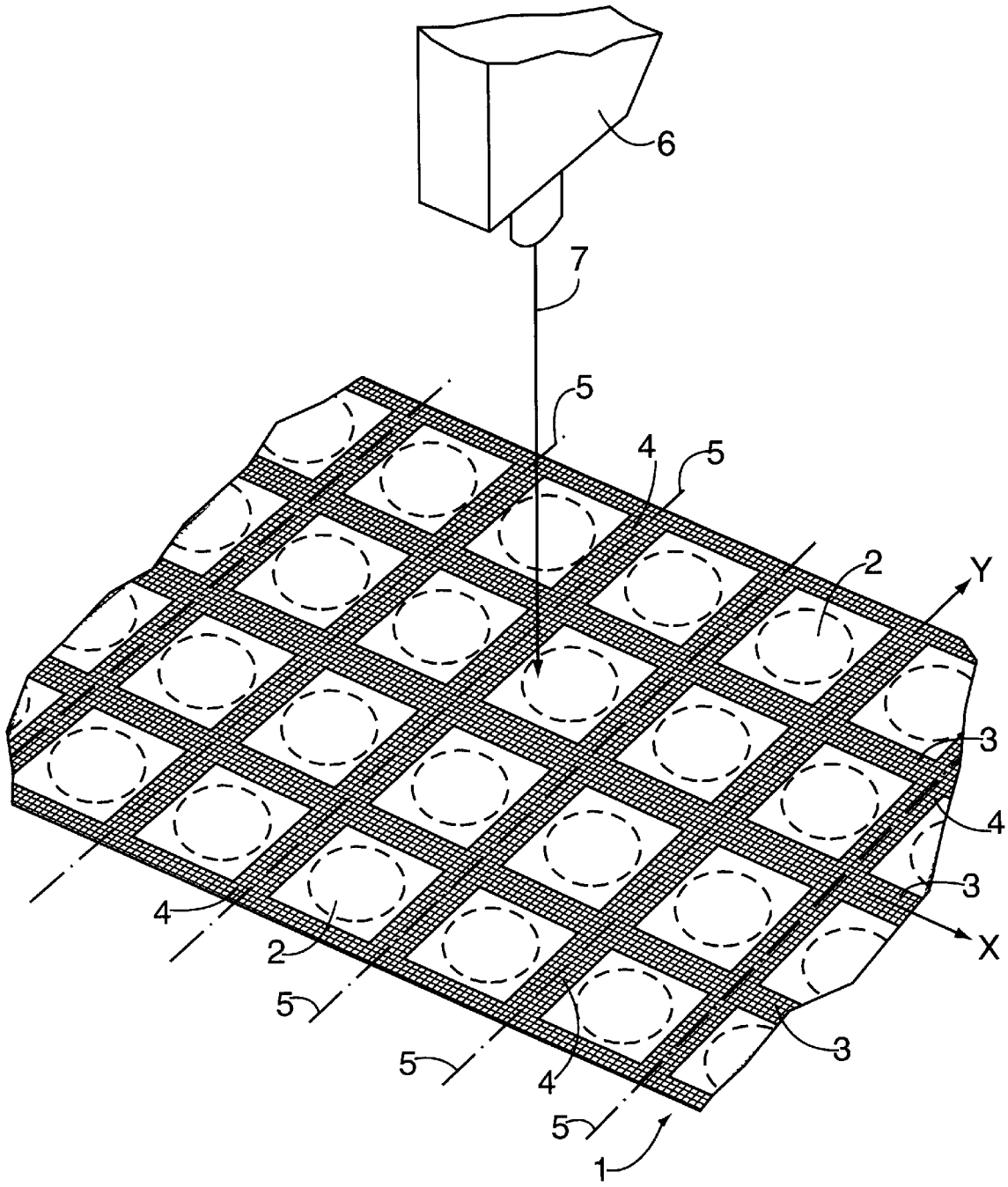
FIG. 1 shows a perspective illustration of a tablet carrier in the form of a strip and having the sealed-in tablets in conjunction with an optical reflection sensor, FIG. 2 diagrammatically shows the passage of the tablet carrier in the form of a strip through a sealing apparatus and subsequent cutting apparatus.

In the case of the tablet carrier 1 illustrated in FIG. 1, each tablet 2 is sealed in a square zone (square) which is bounded by longitudinal sealing webs 3 in the x direction and by transverse sealing webs 4 in the y direction. The tablet carrier 1 comprises a two-layer aluminium foil composite. During the sealing operation, one moisture-sensitive tablet 2 in each case is enclosed in one square or one cell hermetically tightly between the two layers. The sealing webs 3, 4 have a width b of approximately 4 mm and are provided with a lattice-like embossing. In the fabrication mode, the tablet carrier 1 is transported further in the x direction (longitudinal direction) and is cut by a cutter roller in the y direction (transverse direction) after each square into smaller tablet strips, which each contain four tablets 2 in the example shown here. The desired position that is aimed at for the separating cut 5 in this case lies in the centre of the transverse sealing web 4, in which case a tolerance of ±0.5 mm should be complied with. To date, it has not been possible to satisfy this requirement in operational practice. If the separating cut is made at the edge or even outside the sealing edge width b, then airtight packaging and hence the prescribed storage life of the tablets are no longer ensured.

For this reason, provision is made of an optical measuring device in the form of a reflection sensor 6, which scans the surface of the tablet carrier 1 between two longitudinal sealing webs 3 with a laser beam 7. The reflection sensor 6 generates an AC voltage signal whose evaluation yields the exact position and width of the transverse sealing webs 4. On the basis of these measurement information items and monitoring of the web coordinates, the separating cut can then be positioned exactly in the centre of each transverse sealing web 4, with the result that the sealing webs enclosing the tablet always have at least a sealing edge width of b/2 and the hermetically airtight closure of the tablets is no longer jeopardized by an excessively small sealing edge width.

Figure 2:
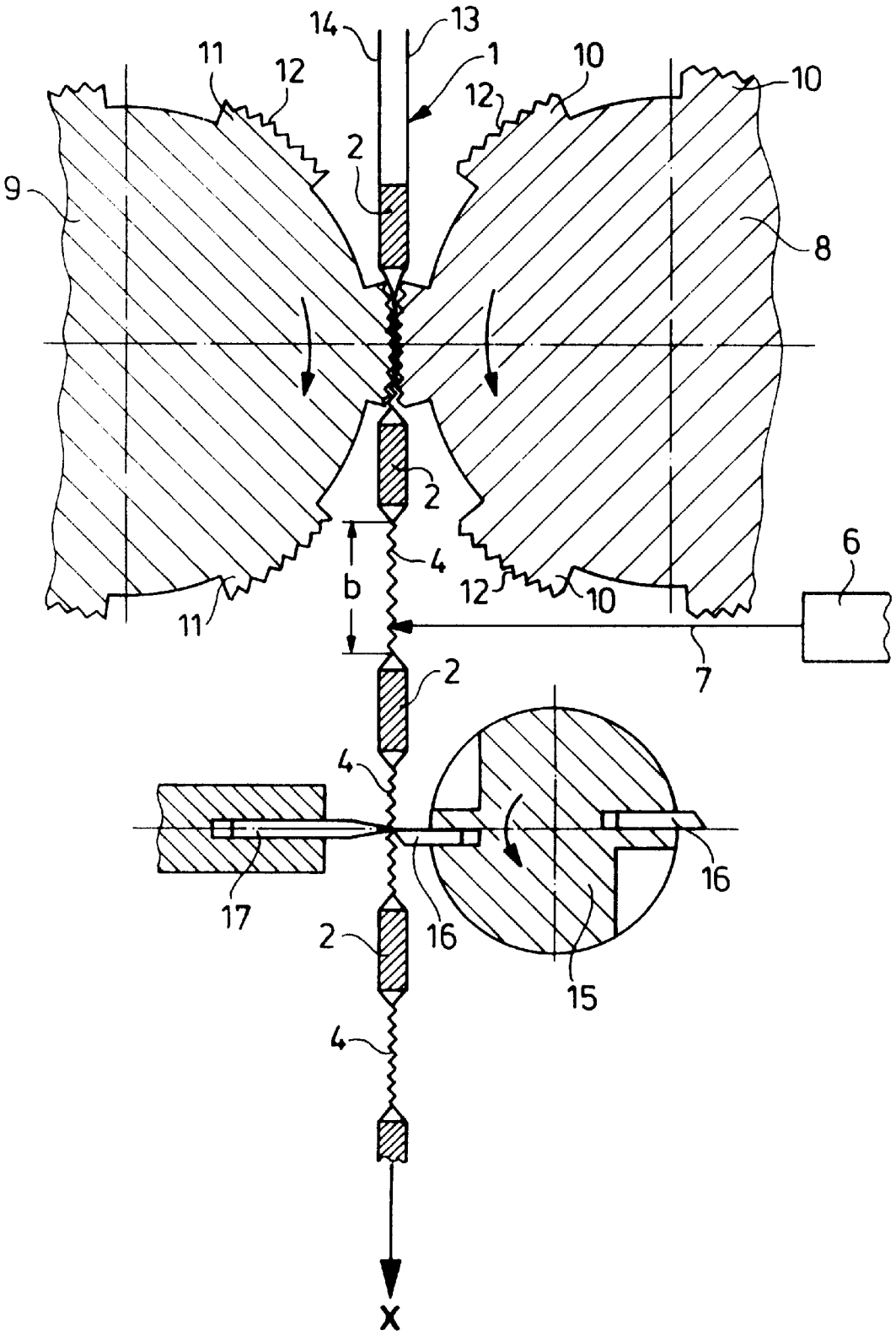

FIG. 2 illustrates the sealing machine and the downstream cutting apparatus, which comprises a rotating cutter roller, in a side view. The tablet carrier 1 is transported further from the top downwards (x direction). The sealing machine comprises two sealing rollers 8 and 9 which rotate in opposite senses and have sealing zones 10 and 11 having toothed or serrated surfaces 12. Under the high pressure of the sealing zones rolling on one another, the foil and film 13 and 14 of the tablet carrier 1 which are situated in between the said zones are fixedly sealed together along a zone b between two successive tablets 2. A sealing seam or the transverse sealing web 4, already described above, having the width b is produced in the process. The serrated surfaces 12 of the sealing zones 10, 11 produce the already mentioned lattice-like embossing in the sealing zone, that is to say on the surface of the transverse sealing web 4. The lattice-like embossing may also comprise (given a corresponding configuration of the sealing zones) a multiplicity of small depressions and elevations.

The downstream cutting apparatus comprises the cutter roller 15 with the chisel edges 16 and the stationary opposite cutting edge 17. The tablet carrier 1 is severed whenever the chisel edge 16 runs past the opposite cutting edge 17. Consequently, the difference in rotational speeds between the rotating sealing rollers 8 and 9 and the rotating cutter roller 15 must be set such that the chisel edge 16 always runs past the opposite cutting edge 17 when the centre line of a sealing web 4 is located exactly opposite the opposite cutting edge 17. In this case, the separating cut, as described above, would be made exactly in the centre of the sealing web. However, on account of length fluctuations of the tablet carrier, which are to be attributed to severe mechanical stresses during the sealing process, the position of the transverse sealing web 4 on the tablet carrier may be displaced in an unforeseeable manner in the x direction, with the result that exact positioning of the separating cut is not possible given a rigid phase shift between the sealing machine 8, 9 and the cutter roller 15.

Figure 3:
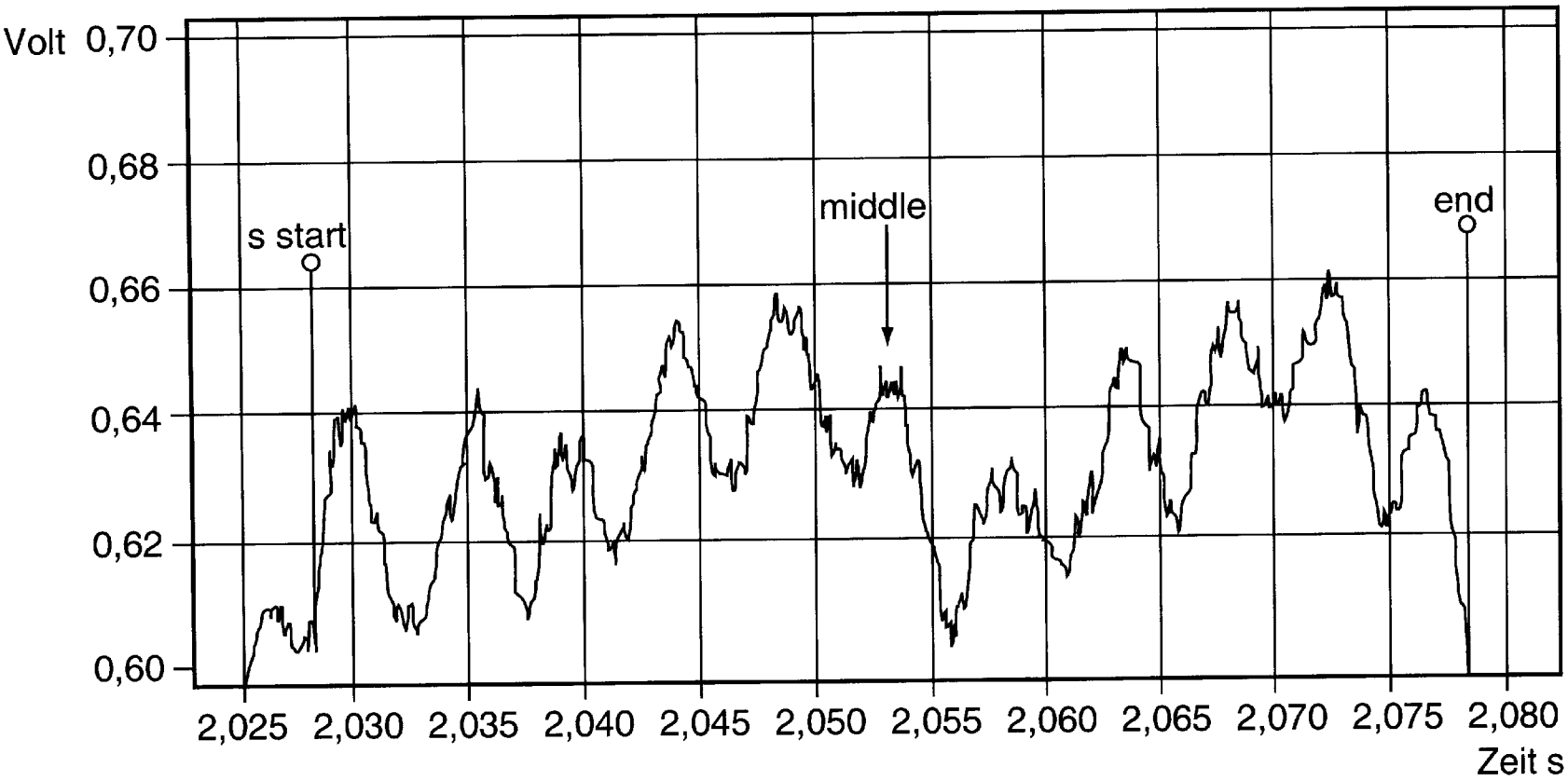
FIG. 3 shows the AC voltage signal present at the reflection sensor.
Figure 4:
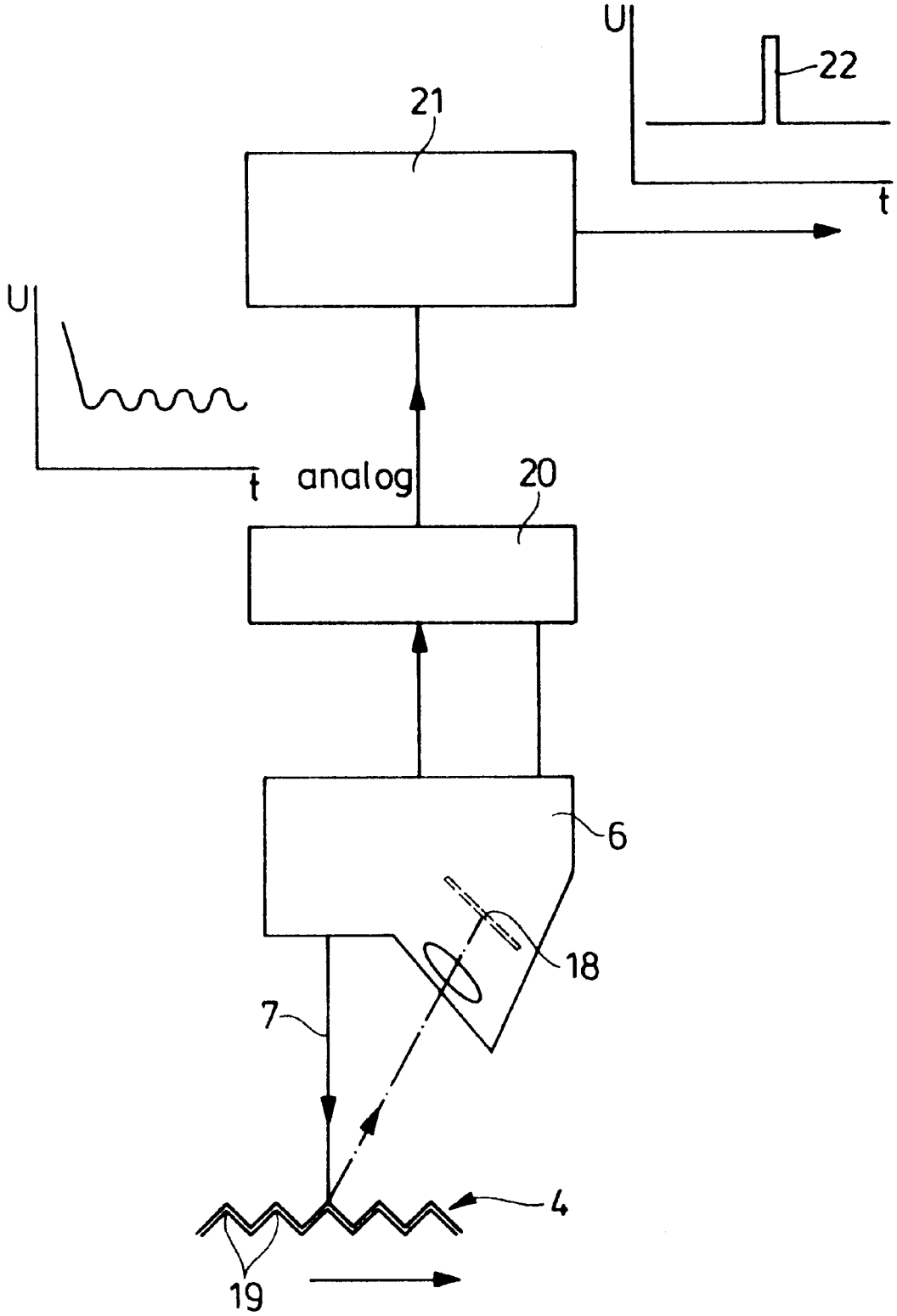
FIG. 4 shows a block diagram for the signal processing.

For this purpose, the position (that is the spatial coordinates in the x direction) and width b of each transverse sealing web 4 are acquired by the reflection sensor 6 and an evaluation circuit connected thereto. The reflection sensor 6 in this case comprises a commercially available, optoelectronic position measuring system which operates according to the triangulation principle. In this case, a laser diode projects a very fine spot of light onto the tablet carrier 1 and/or onto the transverse sealing web 4. Using a receiving optical system, this spot of light is viewed at an acute angle and imaged on a position-sensitive CCD row 18 (see FIG. 4). The measurement signals are subjected to further processing using a fast signal processor and are output as analog values which correspond to the instantaneous distance values between the sensor 6 and the spot of light travelling in the longitudinal direction on the surface of the sealing web 4. A periodic AC voltage, whose time characteristic is illustrated in FIG. 3, is generated in this case on account of the lattice-like embossing 19 (FIG. 4) of the sealing web. The AC voltage starts when the laser beam 7 enters the web region and stops when the laser beam leaves the web region again. Since the period of the AC voltage corresponds to the lattice spacing of the embossings, it is possible to determine very exactly from this the position and width and hence also the centre b/2 of the sealing web; that is to say the sensor and/or the evaluation circuit identifies and localises the transverse sealing webs 4, running past the sensor, and their centres on the tablet carrier 1. In order to improve the measurement signal-to-noise ratio, it is also possible to employ two reflection sensors, one sensor scanning the top side and the other sensor the underside of the tablet carrier. In this way, it is possible to eliminate interference signals caused, for example, by wobbling movements of the tablet carrier.

The AC voltage signal which is generated in the sensor 6 and is characteristic of the embossing 19 is amplified (amplifier 20) and then fed to an evaluation circuit 21, which generates a control pulse 22, which, on the time axis, corresponds to the current position of the web centre of the sealing web 4 just detected by the sensor 6 (also see FIG. 2). In order to control or readjust the cutter roller 15, its current position, which is determined by an angle of rotation sensor connected to it, is then compared with the current position of the web-centre pulse 22 and the controlled variable for controlling the cutter roller motor is formed by subtraction. Depending on the current phase angle of the web-centre pulse 22, the rotational speed of the cutter roller 16 is then accelerated or decelerated in such a way that the chisel edge 16 always arrives at the stationary opposite cutting edge 17 in each case synchronously with the centre line of the sealing web 4. In this way, it is possible to achieve, individually for each transverse sealing web 4 running past, an exact positioning of the separating cut in the sealing web centre with a tolerance of ±0.5 mm and thus a considerable improvement with regard to the reliability of the airtight packaging and storage life of the tablets.

What is claimed is:

1. An apparatus for the accurate cutting of a strip-like carrier, wherein the carrier is transported in at least one of a cyclic and continuous manner in a longitudinal direction, the carrier having cells arranged one behind the other with a sealing web therebetween extending transverse to the longitudinal direction, each sealing web having a lattice-like embossing, the apparatus comprising:

a cutter roller rotatable at a speed of rotation to sever predetermined sealing webs between cells along a severing line;

a light source for directing a beam onto the carrier upstream of the cutter roller to intersect the sealing webs moving past the beam;

an optical reflection sensor positioned at least one of above and below the beam to produce an electrical signal representative of the reflection of the beam from the lattice-like embossing;

an evaluating circuit for evaluating the signal from the sensor to determine the width of each passing sealing web; and a control circuit for controlling the speed of rotation of the cutter roller based upon the evaluated signal to control the position of the severing line to cut each sealing web at the center thereof.

2. The apparatus according to claim 1, wherein the evaluating circuit determines the center according to the triangulation principle.

3. The apparatus according to claim 1, wherein the evaluating circuit generates a control pulse which is representative in time of the center of the passing sealing web and wherein the control circuit alternatively increases and decreases the rotational speed of the cutter roller as a function of the timing of the control pulse.

4. A method for the accurate cutting of a strip-like carrier, comprising the steps of:

transporting a carrier in at least one of a cyclic and continuous manner in a longitudinal direction, the carrier having cells arranged one behind the other with a sealing web therebetween extending transverse to the longitudinal direction, each sealing web having a lattice-like embossing;

rotating a cutter roller at a speed of rotation to sever predetermined sealing webs between cells along a severing line; and controlling the position of severing line by directing a beam onto the carrier upstream of the cutter roller to intersect the sealing webs moving past the beam;

positioning an optical reflection sensor at least one of above and below the beam to produce an electrical signal representative of the reflection of the beam from the lattice-like embossing;

evaluating the signal from the sensor to determine the width of each passing sealing web; and controlling the speed of rotation of the cutter roller based upon the evaluated signal to cut each sealing web at the center thereof.

5. The method according to claim 4, wherein the step of evaluating comprises operating according to the triangulation principle.

6. The method according to claim 4, wherein the step of evaluating comprises generating a control pulse which is representative in time of the center of the passing sealing web and alternatively increasing and decreasing the rotational speed of the cutter roller as a function of the timing of the control pulse.

* * * * *